United States Patent [19]

Kremer et al.

[11] 4,314,876

[45] Feb. 9, 1982

[54] TITANIUM ETCHING SOLUTION

[75] Inventors: Lawrence N. Kremer, Trenton; Matthew A. Boehmer, Allen Park, both of Mich.

[73] Assignee: The Diversey Corporation, Mississauga, Canada

[21] Appl. No.: 130,938

[22] Filed: Mar. 17, 1980

[51] Int. Cl.[3] ..... C23F 1/00

[52] U.S. Cl. ..... 156/664; 252/79.3; 252/79.4

[58] Field of Search ..... 252/79.3, 79.4, 79.2, 252/142; 156/656, 659.1, 664

[56] References Cited

U.S. PATENT DOCUMENTS

| | | | |
|---|---|---|---|
| 3,061,494 | 10/1962 | Snyder et al. | 252/79.3 X |
| 3,078,203 | 2/1963 | LaBoda et al. | 252/79.3 X |
| 3,844,859 | 10/1974 | Roni | 252/79.3 X |

*Primary Examiner*—William A. Powell

*Attorney, Agent, or Firm*—Merriam, Marshall & Bicknell

[57] ABSTRACT

A method of chemically milling metal and particularly for chemically milling titanium and titanium alloys which comprises subjecting these metals to the action of an aqueous acidic medium containing ammonium bifluoride and a source of nitrate ions.

7 Claims, No Drawings

TITANIUM ETCHING SOLUTION

BACKGROUND OF THE INVENTION

1. Field of the Invention

This invention relates to the chemical milling of metal and more particularly to the chemical milling of titanium and titanium alloys.

2. Description of the Prior Art

Prior to specifically discussing chemical milling, it is necessary to point out the manner in which it distinguishes from pickling and brightening. Chemical milling may be considered to be controlled corrosion or controlled metal removal to form sculptured metal configurations. In chemical milling, a relatively large percentage of the original metal may be rapidly removed so as to leave a minor amount of the original metal in a new configuration. As contrasted with this is pickling or scale removal whereby as much as possible of the oxide and other coatings of the metal are removed but as small amount as possible of the metal is removed. In other words, in pickling, only the surface coating of the metal is removed. In brightening or surface polishing, a minimum amount of metal is removed to form a reflective surface, as the scale has been previously removed.

Commercially-used titanium chemical milling solutions are generally a nitric-hydrofluoric acid solution. However, there is substantial room for improvement of the nitric-hydrofluoric acid solutions, in the areas of etching rate, cost, and ease of handling the materials.

Accordingly, it is the purpose of the instant invention to provide a chemical milling solution, particularly for chemical milling titanium and titanium alloys, at reduced cost which etches faster, and has greater ease of handling the components of the solution.

STATEMENT OF RELEVANT PATENTS

U.S. Pat. No. 2,711,364—Beach—relates to a method of polishing articles of metals including titanium. The composition includes as essential components, water-soluble fluoride, nitric acid, and fluosilicic acid. The patent states that a mixture containing 60 grams of ammonium bifluoride per liter in a 50 percent by volume nitric acid was used for polishing zirconium containing some zirconium carbide. As pointed out above, polishing is an entirely different operation from chemical milling.

U.S. Pat. No. 2,828,193—Newman—discloses a method for rejuvenation of aluminum treating solutions and discloses that nitric acid compositions may be used for removing smuts from aluminum surfaces. The patent indicates that the addition of a fluoride ion, from a source such as hydrofluoric acid, alkali metal or ammonium fluoride, or equivalent acid fluoride salts when dissolved in water, produces a relatively mild acidic solution which has the property of dissolving smut. However, there is a substantial difference between smut removal from aluminum surfaces and chemical milling or etching of metals such as titanium and titanium alloys.

U.S. Pat. No. 3,844,859—Roni—discloses a chemical milling or etchant bath for titanium which comprises a nitric-hydrofluoric acid solution wherein the nitric acid content is reduced to a concentration of about 0.2 to 1.2 weight percent. The patent indicates that ammonium bifluoride may be added. However, throughout the patent it is clear that hydrofluoric acid is an essential component and ammonium bifluoride is an additive and not a substitute.

U.S. Pat. No. 2,981,610—Snyder et al—teaches that fluoride ions and nitric acid produce a good etching bath for titanium and its alloys, among other components. Among the numerous examples are two which employ ammonium bifluoride. However, the ammonium bifluoride is employed in solutions which also contain several other components.

U.S. Pat. No. 3,106,499—Kendall, and U.S. Pat. No. 2,620,265—Hesch—are both directed to aluminum brightening processes and compositions which contain ammonium fluoride and nitric acid. However, as pointed out above, there is a substantial difference between brightening and chemical milling. Further, the U.S. Pat. No. 2,620,265 patent contains trivalent chromium as an essential component and the U.S. Pat. No. 3,106,499 patent contains boric acid as an essential component.

SUMMARY OF THE INVENTION

A method of chemically milling metal and particularly for chemically milling titanium and titanium alloys which comprises subjecting these metals to the action of an acidic medium consisting essentially of ammonium bifluoride, a source of nitrate ions, and water.

DESCRIPTION OF THE PREFERRED EMBODIMENT

In a preferred embodiment of this invention, a metal, preferably titanium and titanium alloys, is subjected to the action of an acidic solution consisting essentially of ammonium bifluoride, a source of nitrate ions, and water. A wetting agent, preferably a foaming wetting agent, may also be included. More particularly, the aqueous acidic solution consists essentially of about 3 to 10 percent by weight ammonium bifluoride, 5 to 15 percent by weight nitric acid, 0 to 1 percent, preferably 0.1 to 1 percent by weight of a wetting agent, and 92 to 49 percent by weight water. Other nitrate ion sources may be employed in lieu of nitric acid, such as ammonium nitrate, sodium nitrate, and potassium nitrate in amounts equivalent to 5 to 15 percent by weight nitric acid. Where the latter sources of nitrate ion are employed, it is necessary to include about 2 to 25 percent by weight hydrochloric acid to acidify the solution.

Examples of wetting agents, which have been found to be particularly effective, are the conjugated polyoxypropylene-polyoxyethylene compounds having the following formula:

$$Y[(C_3H_6O)_y(C_2H_4O)_zH]_x$$

where Y is the residue of a low molecular weight (6 carbon atoms per molecule or less) organic compound containing therein x hydrogen atoms capable of reacting with 1,2-propylene oxide, x is an integer greater than 1, y has a value such that the molecular weight of the compound exclusive of the oxyethylene groups is at least 1500, and z has a value such that the oxyethylene groups constitute about 25 to 90 percent of the total weight of the compound.

The properties and preparation of conjugated polyoxypropylene-polyoxyethylene compounds of this type are set forth in U.S. Pat. No. 2,674,619, granted Apr. 6, 1954, to Lester G. Lundsted, which description is incorporated herein by reference. Other well-known wetting agents having relatively high foaming properties, well known to those skilled in the art, may also be employed. Examples of such wetting agents are: hexynol; 3-methyl-1-butyn-3-ol, and anionic fluorosurfactants such as potassium perfluoroalkyl sulfonates.

The temperature of the solution to which the metal is subjected will generally range from about 70° to 120° F.

For a more complete understanding of the present invention, reference is made to the following examples wherein all parts are by weight and all temperatures are in degrees Fahrenheit absent indications to the contrary.

EXAMPLE 1

A three inch by four inch by 0.05 inch thick and a one inch by one inch by 0.10 inch thick coupon of titanium were rinsed with acetone and immersed in a bath in a plastic container maintained at 106° to 110° F. The bath comprised 8 percent by weight ammonium bifluoride, 12 percent by weight nitric acid (70 percent aqueous), balance water, for one hour. Both coupons were rinsed well and dried after etching with acetone. The coupons etched well with the three inch by four inch by 0.05 inch coupon losing 22.69 milligrams weight as a result of the treatment and the one inch by one inch by 0.10 inch coupon losing 1.69 milligrams weight.

EXAMPLE 2

A one inch by one inch by 0.10 inch titanium coupon was treated as described above in Example 1 with the exception that the treatment time was 10 minutes rather than one hour. After ten minutes, the sample was well etched, losing 0.39 milligrams weight. The coupon was then subjected to treatment in the bath for an additional 10 minutes after which it lost an additional 0.40 milligrams weight.

EXAMPLE 3

A three inch by four inch by 0.05 inch thick and a one inch by one inch by 0.10 inch thick coupon of titanium were rinsed with acetone and immersed in a bath in a plastic container maintained at 100° to 110° F. The bath comprised 8 percent by weight ammonium bifluoride, 8 percent by weight of ammonium nitrate, 12 percent by weight hydrochloric acid (36 percent by weight aqueous), balance water, for one hour. Both coupons were rinsed well and dried after etching with acetone. The coupons etched well with the three inch by four inch by 0.05 inch coupon losing 32.72 milligrams weight as a result of the treatment and the one inch by one inch by 0.10 inch coupon losing 3.82 milligrams weight.

EXAMPLE 4

A one inch by one inch by 0.10 inch titanium coupon was treated as described above in Example 3 with the exception that the treatment time was 10 minutes rather than one hour. After ten minutes, the sample was well etched losing 0.45 milligrams weight.

EXAMPLE 5

A three inch by four inch by 0.05 inch thick and a one inch by one inch by 0.10 inch thick coupon of titanium were rinsed with acetone and immersed in a bath in a plastic container maintained at 100° to 110° F. The bath comprised 8 percent by weight ammonium bifluoride, 8 percent by weight of ammonium nitrate, 20 percent by weight hydrochloric acid (35 percent by weight aqueous), 0.2 percent by weight wetting agent, and the balance water, for 10 minutes. The wetting agent was the conjugated polyoxyethylene-polyoxypropylene compound of the type described above wherein the molecular weight of the compound, exclusive of the oxyethylene groups, is 1750 and the oxyethylene groups constitute 80 percent of the total weight of the compound. Both coupons were rinsed well and dried after etching with acetone. The coupons etched well with the three inch by four inch by 0.05 inch coupon losing 12.09 milligrams weight as a result of the treatment and the one inch by one inch by 0.10 inch coupon losing 1.10 milligrams weight.

EXAMPLE 6

A two inch by two inch by 0.10 inch thick and a one inch by one inch by 0.10 inch thick coupon of titanium were rinsed with acetone and immersed in a bath in a plastic container maintained at 100° to 110° F. The bath comprised 8 percent by weight ammonium bifluoride, 8 percent by weight of ammonium nitrate, 12 percent by weight hydrochloric acid (35 percent by weight aqueous), 0.2 percent by weight of the wetting agent of Example 5, and the balance water, for one hour. Both coupons were rinsed well and dried after etching with acetone. The coupons etched well with the two inch by two inch by 0.1 inch coupon losing 0.95 milligrams weight as a result of the treatment and the one inch by one inch by 0.10 inch coupon losing 0.37 milligrams weight.

The embodiments of the invention in which an exclusive privilege or property is claimed are defined as follows:

1. A method for chemically milling a metal comprising subjecting the metal to the action of a solution consisting essentially of 3 to 10 percent by weight of ammonium bifluoride, a nitrate source selected from the group consisting of nitric acid, ammonium nitrate, sodium nitrate and potassium nitrate in amount equivalent to 5 to 15 percent by weight of nitric acid, 2 to 25 percent by weight hydrochloric acid where the nitrate source is ammonium nitrate, sodium nitrate or potassium nitrate, 0 to 1 percent by weight of a wetting agent and 92 to 49 percent by weight water.

2. The method of claim 1 wherein said solution is at a temperature which ranges from about 70° to 120° F.

3. The method of claim 2 wherein said metal is titanium.

4. The method of claim 3 wherein said nitrate source is nitric acid.

5. The method of claim 3 wherein said nitrate source is ammonium nitrate.

6. The method of claim 3 wherein said nitrate source is sodium nitrate.

7. The method of claim 3 wherein said nitrate source is potassium nitrate.

* * * * *

UNITED STATES PATENT AND TRADEMARK OFFICE

CERTIFICATE OF CORRECTION

PATENT NO. : 4,314,876

DATED : February 9, 1982

INVENTOR(S) : LAWRENCE N. KREMER ET AL

It is certified that error appears in the above-identified patent and that said Letters Patent are hereby corrected as shown below:

Column 3, line 17, change "106°" to --100°--.

Signed and Sealed this

*Thirteenth* Day of *April 1982*

[SEAL]

*Attest:*

GERALD J. MOSSINGHOFF

*Attesting Officer*

*Commissioner of Patents and Trademarks*